US007021420B2

(12) United States Patent
Galaitsis

(10) Patent No.: US 7,021,420 B2
(45) Date of Patent: Apr. 4, 2006

(54) SYSTEM AND METHOD FOR PHASED NOISE ATTENUATION

(75) Inventor: Anthony G. Galaitsis, Lexington, MA (US)

(73) Assignee: BBNT Solutions LLC, Cambridge, MA (US)

( * ) Notice: Subject to any disclaimer, the term of this patent is extended or adjusted under 35 U.S.C. 154(b) by 651 days.

(21) Appl. No.: 10/103,672

(22) Filed: Mar. 21, 2002

(65) Prior Publication Data

US 2002/0144860 A1 Oct. 10, 2002

Related U.S. Application Data

(62) Division of application No. 09/690,414, filed on Oct. 17, 2000, now Pat. No. 6,454,047.

(51) Int. Cl.
*F01N 7/02* (2006.01)

(52) U.S. Cl. ..... 181/232; 181/211

(58) Field of Classification Search ..... 181/232, 181/211, 216, 254, 255, 235–237, 253, 252, 181/256, 269, 272
See application file for complete search history.

(56) References Cited

U.S. PATENT DOCUMENTS

| | | | | | |
|---|---|---|---|---|---|
| 4,281,740 | A | * | 8/1981 | Weiss et al. | 181/250 |
| 4,926,636 | A | | 5/1990 | Tadokoro et al. | 181/254 |
| 5,014,817 | A | | 5/1991 | Takato et al. | 181/254 |
| 5,984,045 | A | * | 11/1999 | Maeda et al. | 181/254 |
| 6,178,745 | B1 | * | 1/2001 | Meusen | 60/312 |
| 6,454,047 | B1 | * | 9/2002 | Galaitsis | 181/254 |

* cited by examiner

*Primary Examiner*—Kimberly Lockett
(74) *Attorney, Agent, or Firm*—Ropes & Gray LLP

(57) ABSTRACT

A method and system for attenuating noise including arranging a plurality of accumulators (210, 310) to form a transmittance path for compressible flow mass and noise between a noise source (212, 312) and the external environment (218, 318), and selectively accumulating and confining compressible flow mass and noise within at least one of the plurality of accumulators, and attenuating noise confined within the at least one accumulator by ringdown. The system may include a plurality of interruptors/valves (220, 320) which are operated at respective timings for periodically accumulating and confining compressible flow mass and noise in at least one of the plurality of accumulators.

14 Claims, 4 Drawing Sheets

SYSTEM AND METHOD FOR PHASED NOISE ATTENUATION

This application is a divisional, of application Ser. No. 09/690,414, filed Oct. 17, 2000 now U.S. Pat. No. 6,454,047. Benefits under 35 U.S.C. § 120 are claimed.

BACKGROUND OF THE INVENTION

1. Field of the Invention

The present invention relates generally to systems and methods for noise attenuation, and more particularly to a method and apparatus for attenuating noise through phased accumulation and confinement of compressible flow mass and noise, whereby noise is attenuated by ringdown. The noise attenuation method of the present invention has utility both in exhaust systems and intake systems, and has particular utility in exhaust systems of engines operable under elevated back pressure conditions.

2. Related Art

Sound, including sound noise, is generated by pressure fluctuation in a medium, where the pressure fluctuation propagates through the medium in the form of a pressure wave; the pressure wave transmits acoustic energy. The medium may be solid or fluid, such as liquid, gas or a mixture thereof.

Conventional noise attenuation systems and methods utilize basic sound propagation and dissipation principles to attenuate noise generated by a source, such as the exhaust noise of an engine. Generally, such noise attenuation systems and methods may be characterized as active type or passive type.

Active type noise attenuation systems and methods include noise cancellation pressure waves generated using various electromechanical feed-forward or feed-back control elements and techniques. For example, a source of cancellation sound may be provided in communication with a source of undesirable noise and controlled so as to generate sound/pressure wave fluctuations that are complimentary to the sound/pressure wave fluctuations of the undesirable noise, where the complimentary sound and undesirable noise pressure wave fluctuations are superimposed on each other such that the respective pressure wave fluctuations cancel each other out.

Passive type noise attenuation systems and methods are those whose noise attenuation performance is a function of the geometry and sound absorbing properties of the system components. Sound, that is, acoustic energy transmitted in the form of pressure waves, decays naturally by conversion into heat. This conversion may occur by either one or both of i) molecular relaxation in the bulk of the acoustic propagation medium, and ii) interaction between the pressure wave/medium and any sound absorbing boundaries of the system, such as sound absorbing walls, linings, and the like.

Conventional active type and passive type systems may include one or any number of noise attenuating components or elements, such as pipes, chambers, ducts, reflection walls, projections, perforated structures, and the like, or portions thereof, lined or unlined, variously arranged to provide area discontinuities, impedance discontinuities, reflective surfaces, absorptive surfaces, and the like, for directing, reflecting, absorbing and attenuating noise (acoustic energy/pressure waves).

A discussion of various conventional noise attenuation structures, their operating principles, and various analytical methods, including the transfer matrix approach and the finite-element, boundary element, and acoustical-wave finite-element methods, may be found in Beranek and Ver, "Noise and Vibration Control Engineering; Principles and Applications", John Wiley & Sons, Inc. (1992).

FIG. 1 schematically illustrates a generic silencer (muffler) 110 utilizing conventional passive type noise attenuating elements and methods. As shown therein, exhaust (a compressible flow mass) and noise from a noise source (shown in phantom) 112, such as an engine, flow through a transmittance path including an inlet 114, a plurality of passive type noise attenuating elements (e.g., tubes, chambers, perforated structures, and the like), and an outlet 116 to an external environment (shown in phantom) 118. As shown by arrows therein, noise (acoustic energy/pressure waves) from the noise source generally is directed and redirected at impedance discontinuities, walls and other structural features, so as to be attenuated.

By design, conventional noise attenuation systems such as the silencer of FIG. 1 feature a continuously open transmittance path for flow of compressible exhaust mass and noise, between the noise source and the external environment. Noise attenuation is achieved through (1) acoustic wave reflection at cross-sectional discontinuities, which impede sound propagation but permit a continuous gross flow of compressible exhaust mass, and (2) acoustic energy dissipation resulting from sound wave interaction with absorptive boundaries or walls. As schematically illustrated in FIG. 1, for example, an acoustic wave (noise) incident at inlet 114 of silencer 110 (see large arrow 115A) is attenuated as it flows through and exits silencer 110 (see small arrow 115B). Attenuation of the acoustic wave is achieved by reflections at impededence discontinuities (see, e.g., arrow 115C) and by absorption, e.g., at absorptive boundary 119 (see successively diminishing arrows 115D, 115E, 115F). Conventional noise attenuation systems have a relatively steady (substantially continuous) gross flow of compressible exhaust mass through a defined transmittance path, where the gross flow experiences superimposed fluctuations at the source (source volume flow cycle) under fixed operating conditions, such as an engine exhaust cycle.

Although conventional noise attenuation systems and methods have utility in many applications, such systems and methods have a drawback in that achievable noise attenuation is limited because the interaction of the propagating sound waves with noise attenuating structures in such conventional systems generally is limited to the time the sound waves (noise) take to propagate through the length of the transmittance path of the noise attenuating system. A need exists for an improved system and method for attenuating noise.

SUMMARY OF THE INVENTION

The present invention generally provides a novel method for phased noise attenuation. According to the present invention, a noise attenuation method is provided in which flow of compressible flow mass and noise is phased, by periodically accumulating and substantially confining a compressible fluid flow mass and noise in at least one defined volume of a transmittance path, for a time sufficient to attenuate noise confined in the defined volume by ringdown. A noise attenuation system using a method of the present invention thus provides a non-continuous transmittance path for compressible flow mass and noise between a noise source and an external environment.

The present invention also generally relates to a noise attenuation system and method which provides periodic physical blockage of a compressible fluid borne sound transmission path, such as from an engine to an external environment, at a plurality of different locations of the transmittance path, providing temporary confinement of compressible flow mass and acoustic energy in at least one of plural accumulators of the system (noise attenuator), whereby noise is attenuated by a prolonged period of a) sound absorption by propagation in the medium within the accumulator, and/or b) sound interaction with dissipative accumulator surfaces and boundaries, and wherein the overall transmittance path is continuously, selectively blocked ("non-continuous").

At In one aspect, the present invention relates to a noise attenuator including a transmittance path for compressible flow mass and noise, and phased transmittance means for selectively accumulating and confining compressible flow mass and noise in a defined volume of the transmittance path so as to attenuate noise within the defined volume by ringdown.

In another aspect, the present invention relates to a noise attenuator including a plurality of accumulators arranged in series and collectively providing a transmittance path for compressible flow mass and noise between a noise source and an external environment, where the plurality of accumulators include a first accumulator disposed immediately adjacent the noise source, and phased transmittance means for selectively accumulating and confining compressible flow mass and noise from the noise source within at least one of the plurality of accumulators disposed downstream of the first accumulator, at respective timings, thereby attenuating exhaust noise within the at least one accumulator by ringdown.

In yet another aspect, the present invention relates to a noise attenuator including a plurality of accumulators each providing an independent transmittance path for compressible flow mass and noise between a noise source and an external environment, and phased transmittance means for selectively accumulating and confining compressible flow mass and noise from the noise source within each of the plurality of accumulators, at respective timings, thereby attenuating noise within each of the plurality of accumulators by ringdown.

In still another aspect, the present invention relates to a noise attenuator including a first accumulator and a second accumulator providing a transmittance path for compressible flow mass and noise between a noise source and an external environment, a first interrupter provided in fluid communication with the first accumulator and selectively operable to effectively block the transmittance path through the first accumulator at a first timing, and a second interruptor provided in fluid communication with the second accumulator and selectively operable to effectively block the transmittance path through the second accumulator at a second timing, different than the first timing, whereby the transmittance path from the noise source to the external environment is non-continuous.

In one embodiment, the first accumulator and the second accumulator are arranged in series configuration.

In another embodiment, the first accumulator and the second accumulator are arranged in parallel configuration.

In each embodiment, each interrupter may be a conventional valve, such as a pipe valve, controlled by conventional control elements well known in the art.

In another aspect, the present invention relates to a method for attenuating noise in a noise transmittance path, including selectively, e.g., periodically, accumulating and confining compressible flow mass and noise within at least one defined volume of the transmittance path and attenuating the noise confined within the defined volume by ringdown.

In one embodiment, the method includes forming the noise transmittance path using a plurality of accumulators, and periodically confining the compressible flow mass and noise in the defined volume using a plurality of interrupters.

In another aspect, a noise attenuation method and system according to the present invention may be used with a conventional engine, whereby exhaust and noise from the engine are selectively accumulated and confined in at least one accumulator, for a time sufficient to attenuate the exhaust noise by ringdown.

These and other objects, features and advantages will be apparent from the following description of the preferred embodiments of the present invention.

BRIEF DESCRIPTION OF THE DRAWINGS

The present invention will be more readily understood from a detailed description of the preferred embodiments taken in conjunction with the following figures.

DETAILED DESCRIPTION OF THE PREFERRED EMBODIMENTS

Figure 1:
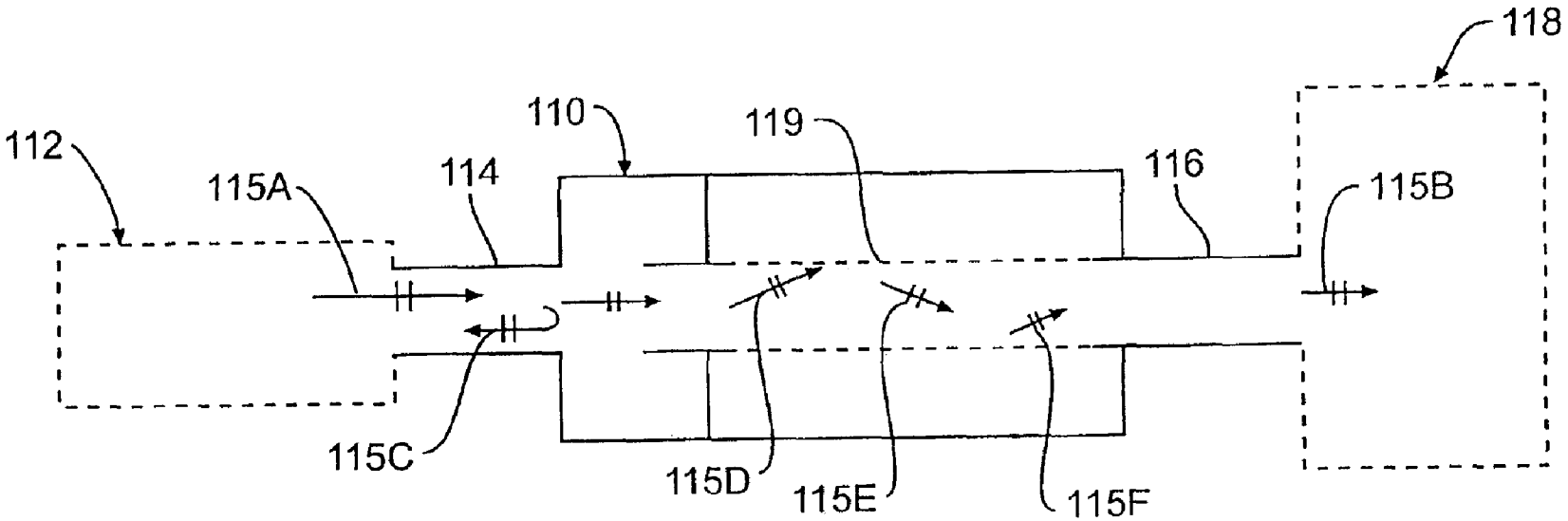
FIG. 1 PRIOR ART
FIG. 1 schematically illustrates a generic silencer design.

The method of the present invention generally achieves noise attenuation by phased accumulation and confinement of compressible flow mass and noise in a transmittance path of a noise attenuation system. Specifically, a transmittance path for compressible fluid borne sound, e.g., between a noise source and an external environment, is periodically interrupted at a plurality of predetermined points along the transmittance path, at a plurality of predetermined times that are different for each of the respective plurality of predetermined points, where the predetermined times are coordinated/sequenced so as to periodically accumulate and confine compressible flow mass and noise in at least one confinable volume defined between two of the plurality of predetermined points in the transmittance path for a time sufficient to attenuate noise confined in the volume by ringdown, and where the predetermined times further are coordinated/sequenced so that at all times the transmittance path is selectively interrupted at at least one of the plurality of points along the transmittance path, whereby the transmittance path between the noise source and the external environment is continuously interrupted ("non-continuous"). The transmittance path may include a plurality of accumulators and a plurality of interrupters variously arranged in a series configuration, a parallel configuration, or a combination thereof.

As used herein, "noise" means undesired sound.

As used herein, "noise source" means a source of noise associated with an unsteady (time varying) generation of pressure waves in a compressible flow mass. In the examples and embodiments described below, the noise source is a source of compressible exhaust and noise, such as a conventional engine.

As used herein, "external environment" means a location or locations remote from a noise source. In the examples and embodiments described below, the external environment may be any remote fluid medium, such as air, atmosphere, any other gas, water, any other fluid, or any combination thereof, bounded or unbounded.

As used herein, "accumulator" means an element, a portion of an element, or a collection of elements of a noise attenuation system that individually or collectively provides a contiguous portion of a transmittance path for compressible flow mass and noise (that is, a "defined volume"), in which portion compressible flow mass and noise selectively may be accumulated and effectively confined (i.e., a "confinable volume"). In the examples and embodiments described below, an accumulator is a portion of a transmittance path for compressible exhaust mass and noise, between a noise source, such as a conventional engine, and an external environment, in which portion compressible exhaust mass and noise selectively may be accumulated and effectively confined. Examples of such elements include pipes, chambers, ducts, and the like, or portion thereof, lined or unlined, and other structures variously including one or more of such elements, such as conventional silencers. An accumulator may be an active type structure or a passive type structure.

As used herein, "interrupter" means a device, structure or combination of structures the operation of which may be controlled to effectively block a transmittance path for compressible flow mass and noise in a noise attenuation system, whereby compressible flow mass and noise are effectively prevented from passing between a portion of the transmittance path upstream of the interrupter and a portion of the transmittance path downstream of the interruptor. Examples include conventional valves, such as pipe valves, and other structures, or combinations of more than one valve or such structures. Each interrupter also includes conventional control elements, such as mechanically, electromechanically or computer driven switches, providing means for controlling or selectively operating the interrupter at predetermined times to mechanically or physically block the transmittance path.

As used herein, "timing" refers to a time or times in which operation steps or other actions are performed. For example, timings may be in sequence, where one or more operation steps selectively may be performed at a predetermined time or at respective predetermined times. Example sequences include opposing timings, where mutually exclusive operations are executed at substantially the same predetermined time to collectively perform a desired function, and complimentary timings, where two or more independent or mutually exclusive operations are performed sequentially or at substantially or approximately the same predetermined time so as to cooperate in order to collectively perform a desired function (see, for example, description of "rapid switching" steps below).

As used herein, "ringdown" means the process by which noise (acoustic energy) effectively confined within a defined volume, such as an accumulator, naturally decays over time. Examples of the ringdown process include a prolonged propagation of acoustic waves in a naturally attenuating medium within a defined volume (accumulator), and/or an increased number of multiple reflections of acoustic waves at dissipative boundaries within the defined volume (accumulator). As noted above, ringdown also may be achieved in an active type noise attenuation system.

As used herein, "minimum ringdown time" ("$T_{ringdown-min}$") means the minimum time required for noise effectively confined in a defined volume, such as an accumulator, to decay by a desired amount through ringdown. Factors that directly influence $T_{ringdown-min}$ include (1) the size of the defined volume (accumulator); (2) the dissipative properties of the medium in the defined volume (accumulator); (3) the presence of any sound absorbing treatments on exposed surfaces within the defined volume (accumulator); and (4) the sound decay criteria required for a desired application.

As used herein, "pump-up time" ("$T_{pump-up}$") means the time required for compressible flow mass and noise to accumulate in a defined volume, such as an accumulator, in an amount sufficient to increase the pressure in the defined volume (accumulator) to a predetermined value, and "maximum pump-up time" ("$T_{pump-up-max}$") corresponds to the time a transmittance path may be effectively blocked before accumulation of compressible flow mass and noise increases an upstream pressure to a value which compromises the performance of a noise source located upstream or compromises the structural integrity of the noise attenuation system. In the examples and embodiments described below, $T_{pump-up-max}$ is the maximum time compressible exhaust mass and noise may be accumulated in an accumulator, that is, the maximum time the transmittance path may be blocked by an interrupter, before pressure upstream of the interrupter increases to a value that compromises the mechanical performance of a noise source located upstream, such as an engine to which the noise attenuation system is attached, or compromises the structural integrity of the noise attenuation system. Factors that directly influence T pump-up and $T_{pump-up-max}$ include (1) the size of the defined volume (accumulator), (2) the flow rate into the defined volume (accumulator), (3) the compressibility of the flow mass, and (4) the type of noise source to which the noise attenuation system is attached, e.g., an engine, and its performance requirements.

As used herein, "ringdown time" ("$T_{ringdown}$") means the actual time that compressible flow mass and noise is confined within a defined volume, such as an accumulator, to achieve a desired amount of noise attenuation by ringdown. In the examples and embodiments described below, $T_{ringdown}$ is the time compressible exhaust mass and noise are confined within an accumulator to achieve a desired amount of noise attenuation by ringdown. Generally, noise can be attenuated/reduced by any desired amount through ringdown provided it is confined in a fixed volume for a sufficiently long period of time. In the examples and a embodiments described below, $T_{ringdown}$ must equal or exceed $T_{ringdown-min}$, to provide a desired noise reduction, but must be shorter than or equal to $T_{pump-up-max}$, to avoid over-pressurization upstream of the defined volume (accumulator) that may compromise the performance of the noise source (engine) or compromise the structural integrity of the noise attenuation system (e.g., the accumulator). Namely, $$T_{ringdown-min} \cdot T_{ringdown} \cdot T_{pump-up} \cdot T_{pump-up-max} \quad (1)$$

Preferably, $T_{rigndown}$ is sufficient to achieve significant attenuation of the noise by ringdown, and most preferably $T_{ringdown}$ is sufficient to substantially eliminate the noise by ringdown.

Factors that directly influence $T_{ringdown-min}$ include (1) the size of the defined volume (accumulator), (2) the dissipative properties of the medium in the defined volume (accumulator), (3) the presence of any sound absorbing treatments on exposed surfaces of the defined volume (accumulator), and (4) the sound decay criteria required for a desired application.

Ideally, $T_{ringdown}$ is much less than $T_{pump-up}$, that is $$T_{ringdown} << T_{pump-up} \quad (2)$$

the actual confinement time $T_{ringdown}$ is substantially equal to $T_{ringdown-min}$, that is $$T_{ringdown} \cdot T_{ringdown-min} \quad (3)$$

and the pump-up time $T_{pump-up}$ is substantially equal to the maximum pump-up time $T_{pump-up-max}$, that is $$T_{pump-up} \cdot T_{pump-up-max} \quad (4)$$

It will be appreciated that Equations (2), (3) and (4) satisfy the relation expressed by Equation (1), and that such a system design may achieve the desired acoustic performance with minimum impact on engine performance.

The method of the present invention will be more readily understood by reference to the following schematic examples of noise attenuating systems according to the present invention.

Figure 2:
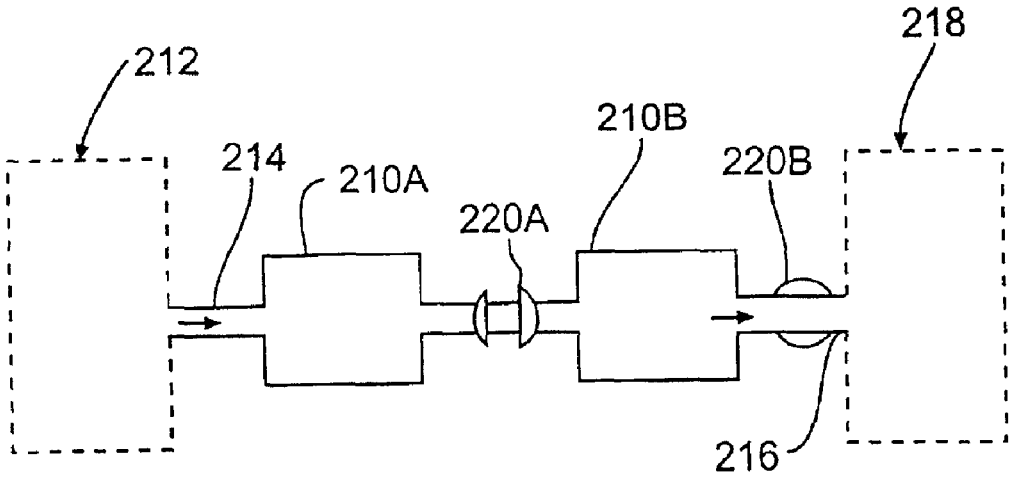
FIG. 2 is a block diagram schematically illustrating a phased noise attenuation system of the present invention including a plurality of accumulators arranged in a series configuration.

FIG. 2 is a block diagram schematically illustrating a phased noise attenuation system according to the present invention, including a plurality of accumulators arranged in a series configuration (Example I). In one aspect, as shown therein, in its simplest form a series configuration noise attenuation system includes two accumulators 210A, 210B and two interrupters (e.g., valves) 220A, 220B arranged in series and collectively providing a single transmittance path for compressible flow mass and noise between a noise source 212 (shown in phantom) and an external environment 218 (shown in phantom). The first accumulator 210A is arranged for fluid communication with the noise source 112 through an inlet 214. The second accumulator 210B is arranged for fluid communication with accumulator 210A and for fluid communication with the external environment 218 through an outlet 216. The first interrupter 220A is arranged in the transmittance path between the first accumulator 210A and the second accumulator 210B. The second interrupter 220B is arranged in the transmittance path between the second accumulator 210B and the outlet 216 to the external environment 218. Each of the interrupters 220A, 220B also includes conventional control elements, providing means for controlling operation of the interrupters 220A, 220B.

Each of the plurality of accumulators 210A, 210B may have any desired structure. In simplest form, each accumulator 210A, 210B may be a simple accumulation/expansion chamber. Alternatively, each of accumulators 210A, 210B variously may include one or more internal elements or components. For example, each accumulator 210A, 210B could be a generic silencer, as shown in FIG. 1. Moreover, accumulator 210A and accumulator 210B could be identical or could have different structures. If identical, manufacturing may be simplified, as these elements would be interchangeable. Alternatively, for example, since accumulator 210A is immediately adjacent the noise source 212 and therefore may be subjected to a higher operating pressure than accumulator 210B, which is downstream of accumulator 210A, it may be desirable to provide accumulator 210A with a different structure having a greater maximum operable pressure characteristic than accumulator 210B. Those skilled in the art readily will be able to select desired structures and configurations for each of the plurality of accumulators based on the desired application.

Likewise, each of the plurality of interrupters 220A, 220B may have any desired structure suitable for performing the desired functions of selectively enabling periodic gross flow and acoustic wave transmission, that is, periodically interrupting or blocking the transmittance path and temporarily accumulating flow mass and noise in respective accumulators through suitably time-sequenced operation. In simplest form, each of the interrupters 220A, 220B may include a conventional valve, such as a pipe valve, and associated control elements. However, those skilled in the art readily will appreciate numerous alternative valves and other structures suitable for performing the desired functions of the interrupters 220A, 220B.

Figure 3:
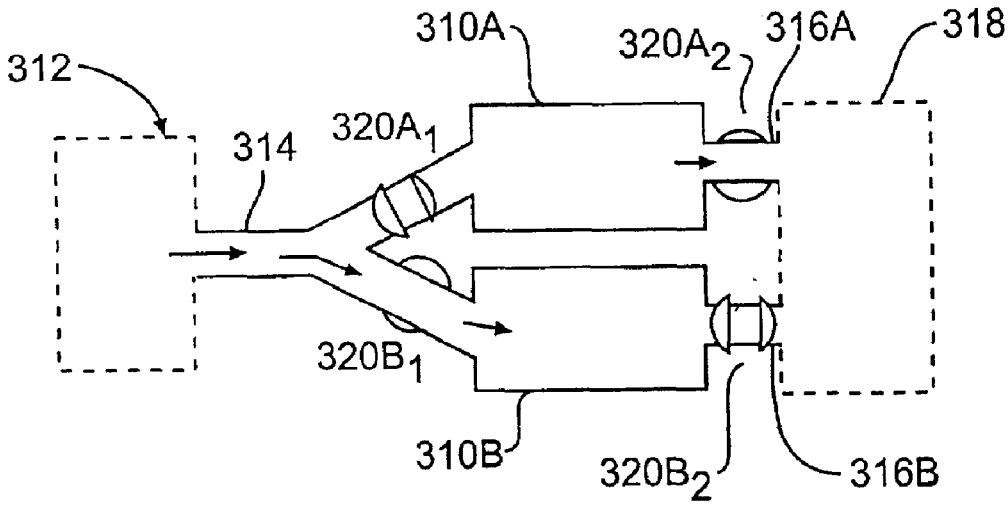
FIG. 3 is a block diagram schematically illustrating a phased noise attenuation system of the present invention including a plurality of accumulators arranged in a parallel configuration.

FIG. 3 is a block diagram schematically illustrating a phased noise attenuation system according to the present invention including a plurality of accumulators arranged in a parallel configuration (Example II). In one aspect, as shown therein, in its simplest form the system includes two accumulators 310A, 310B and two interrupters 320A, 320B arranged in a parallel configuration to provide respective transmittance paths for compressible fluid flow and noise between a noise source 312 (shown in phantom) and an external environment 318 (shown in phantom). The first accumulator 310A is arranged for fluid communication with the noise source 312 through an inlet 314, and for fluid communication with the external environment 318 through an outlet 316A. Likewise, the second accumulator 310B is arranged for fluid communication with the noise source 312 through inlet 314, and for fluid communication with the external environment 318 through an outlet 316B. Although in FIG. 3 each accumulator 310A, 310B is illustrated as arranged in fluid communication with a single common inlet 314, it readily will be appreciated that each accumulator 310A, 310B could be provided with a respective inlet from a common upstream accumulator of the noise source 312. Likewise, although in FIG. 3 each accumulator 310A, 310B is illustrated as arranged in fluid communication with the external environment 318 through a respective outlet 316A, 316B, it readily will be appreciated that such outlets may be combined (merged) so as to converge into a single outlet. A first interrupter 320$A_1$ is arranged in the transmittance path of the first accumulator 310A between accumulator 310A and the inlet 314, and a second interrupter 320$A_2$ is arranged in the transmittance path of the first accumulator 310A between accumulator 310A and outlet 316A. Likewise, a third interrupter 320$B_1$ is arranged in the transmittance path of the second accumulator 310B between accumulator 310B and inlet 314, and a fourth interrupter 320$B_2$ is arranged in the transmittance path of the second accumulator 310B between second accumulator 310B and outlet 316B. As in the series configuration of Example I (FIG. 2), in Example II each interrupter 220$A_1$, 220$A_2$, 220$B_1$, 220$B_2$ includes conventional control elements, such as switches or the like, providing means for controlling operation of the interrupters 220$A_1$, 220$A_2$, 220$B_1$, 220$B_2$.

Each of the plurality of accumulators may have any desired structure. In its simplest form, each accumulator 310A, 310B may be a simple accumulation/expansion chamber, but alternatively, variously may include one or more internal elements or components, or may be a conventional silencer (see FIG. 1), as discussed above. Accumulator 310A and accumulator 310B may be the same or have a different structure/configuration. Preferably, accumulator 310A and accumulator 310B have similar or identical structures, which simplifies manufacturing because the elements are interchangeable, and simplifies operation, as readily will be apparent from the detailed discussion of operation principles below. Those skilled in the art readily will be able to select desired structures and configurations for each of the plurality of accumulators based on the desired application.

Likewise, each of the plurality of interrupters may have any desired structure suitable for performing the desired functions of selectively enabling periodic gross flow and acoustic wave transmission, that is, periodically interrupting or blocking the transmittance path and temporarily accumulating compressible flow mass and noise in the respective accumulators through suitably time-sequenced operation. In simplest form, each of the interrupters may include a valve, such as a pipe valve, and associated control elements. However, those skilled in the art readily will appreciate numerous alternative valves and other structures suitable for performing the desired functions of the disclosed interrupters.

As will be readily apparent from the detailed description of a corresponding first embodiment and second embodiment below, each of the series and parallel configuration systems of Example I and Example II satisfies the above discussed relationships for noise attenuation by ringdown.

A first embodiment of a noise attenuation system of the present invention now will be described in detail with reference to FIG. 2 and Example I. Specifically, in this embodiment the noise attenuation system is a phased exhaust system for attenuating exhaust noise of a noise source 212 such as a conventional engine. As noted above, the phased noise attenuation system of FIG. 2 includes a plurality of accumulators and a plurality of interrupters arranged in a series configuration. Specifically, first accumulator 210A is provided in fluid communication with the noise source 212, such as a conventional engine, through inlet 214; second accumulator 210B is provided in fluid communication with first accumulator 210A and in fluid communication with the external environment 218 through outlet 216; first interrupter 220A (valve $V_1$) is provided in the transmittance path between first accumulator 210A and second accumulator 210B; and second interrupter 220B (valve $V_2$) is provided in the transmittance path between second accumulator 210B and the external environment 218. In the present embodiment, each of the interrupters 220A, 220B comprises a conventional valve, such as a pipe valve, and conventional control elements for selectively operating each valve at respective timings, as discussed below. That is, the control elements provide means for controlling operation of interrupters 220A, 220B (valves $V_1$, $V_2$).

Figure 4:
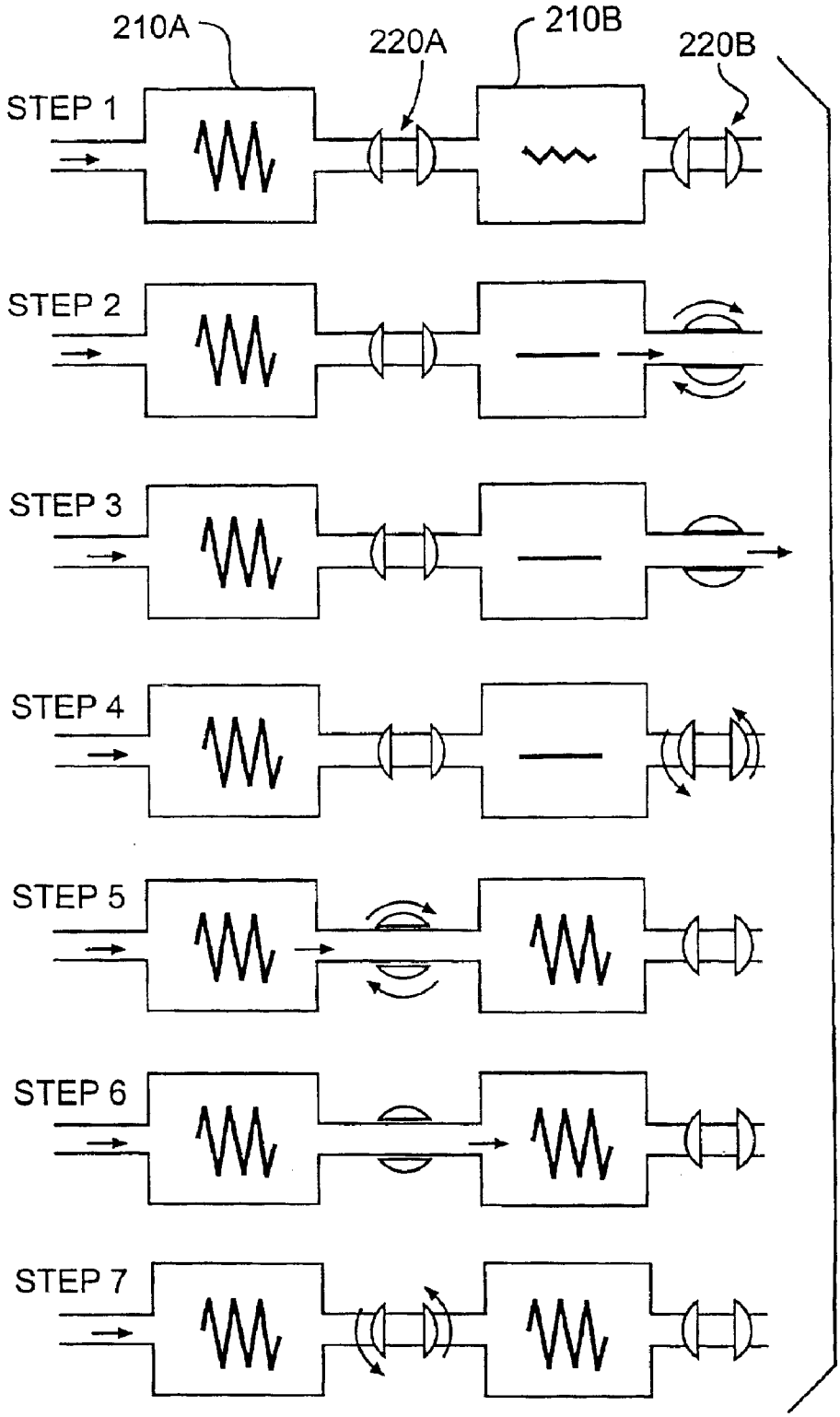
FIG. 4 is a pictorial flow chart illustrating operation of a series configuration phased noise attenuation system of FIG. 2.

Operation of a series configuration phased exhaust/noise attenuation system of FIG. 2, including two accumulators and two interrupters, will now be described with reference to the flow chart illustrated in FIG. 4. As shown therein, operation of the series configuration phased exhaust/noise attenuation system generally comprises seven steps, as follows:

Step (1); Ringdown:

Each of interrupters 220A and 220B is set in a closed state, where transmission of exhaust flow mass and noise is effectively interrupted at each interrupter 220A, 220B (valves $V_1$, $V_2$)

Exhaust flow mass (gases) and noise from the noise source 212 flow from the noise source 212 into accumulator 210A, and accumulate therein. It will be appreciated that as exhaust flow mass and noise accumulate in accumulator 210A, the pressure in accumulator 210A (and the inlet 214 upstream of accumulator 210A) gradually will increase.

Exhaust flow mass and noise (acoustic energy) previously accumulated in accumulator 210B is confined therein for a predetermined time $T_{ringdown}$, and noise confined in accumulator 210B is attenuated by ringdown.

Step (2); $V_2$Opening:

Interruptor 220A remains set in a closed state. Accordingly, exhaust flow mass and noise from the noise source 212 continue to flow into accumulator 210A and accumulate therein, whereby the pressure in accumulator 210A continues to increase.

Interruptor 220B is opened. In this manner exhaust flow mass confined at an elevated pressure in accumulator 210B will begin to release through interrupter 220B and the outlet 216 to the external environment 218. Interruptor 220B preferably is opened in accordance with a predetermined, controlled, opening profile. Specifically, interruptor 220B preferably is controlled to open over a predetermined period of time "$T_{V2opening}$" with an opening profile that minimizes any noise generated by expansion of compressed flow mass confined in accumulator 210B as it is transmitted through interrupter 220B and the outlet 216. Generally, as $T_{V2opening}$ becomes greater, the amount of noise generated by transmission through interrupter 220B becomes less. However, $T_{V2opening}$ preferably is selected to be small relative to other time periods in Steps 1 to 7, and most preferably is selected to be substantially less than $T_{ringdown}$ (that is, $T_{V2opening} \ll T_{ringdown}$). The opening profile preferably also is selected to minimize any noise generated by transmission of flow mass through interruptor 220B. For example, the opening profile may be a quasi-parabolic opening profile, in which the rate of opening starts slowly and gradually increases until the interrupter is fully open. However, those skilled in the art readily will be able to select a combination of $T_{V2opening}$ and opening profile suitable for the desired application.

Step (3); Venting:

Interruptor 220A remains in the closed state. Exhaust flow mass and noise from the noise source 212 continue to flow into accumulator 210A and accumulate therein, whereby the pressure in accumulator 210A continues to increase.

Interruptor 220B remains in an open state for a time $T_{vent}$, so as to permit venting of accumulator 210B. Preferably, $T_{vent}$ is selected so as to permit substantial venting of all exhaust flow mass confined in accumulator 210B by transmittance through interrupter 220B and the outlet 216 to the external environment 218, whereby the pressure within accumulator 210B will approach that of the external environment 218. Since noise (acoustic energy) in accumulator 210B was effectively attenuated by ringdown in Step (1) above, it will be appreciated that no significant engine exhaust noise will be transmitted to the external environment 218 during the venting of step (3).

Step (4); $V_2$ Closing:

Interruptor 220A remains in the closed state. Exhaust flow mass and noise continue to flow into accumulator 210A and accumulate therein, whereby the pressure in accumulator 210A continues to increase.

Interruptor 220B is closed to isolate accumulator 210B from the external environment 218. Preferably, interruptor 220B is closed as quickly as possible, and most preferably is closed within a time $dt_1 \sim 0$.

Step (5); $V_1$ Opening:

Interruptor 210A is opened. It will be appreciated that the pressure in accumulator 210A now is significantly elevated relative to the pressure in vented accumulator 210B, and flow mass and noise accumulated at pressure in accumulator 210A will begin to flow from accumulator 210A through interrupter 220A into accumulator 210B. It also will be appreciated that acoustic energy (noise) previously accumulating in accumulator 210A has not been effectively confined so as to permit attenuation by ringdown in accumulator 210A. Finally, it will be appreciated that any fluid borne noise generated by opening interrupter 220A generally will be added to the existing accumulated exhaust noise.

Interruptor 220B remains in the closed state, so that exhaust flow mass and noise transmitted from accumulator 210A through interrupter 220A into accumulator 210B begins to accumulate in accumulator 210B, whereby pressure in accumulator 210B begins to increase.

Since interrupter 220B is closed and interrupts the transmittance path of exhaust flow and noise to the external environment 218, fluid borne noise transmittance to the external environment 218 is effectively blocked. Accordingly, it will be appreciated that interrupter 220A preferably has a structure and configuration selected to maximize a flow rate therethrough, and is opened as quickly as possible, most preferably within a time $dt_2$~0, to maximize transmission of exhaust flow and noise into accumulator 220B in a minimum amount of time.

Step (6); Charging:

Exhaust flow mass and noise from the noise source 212 continue to flow from noise source 212 through inlet 214 into accumulator 210A.

Interruptor 220A remains in the open state for a predetermined time $T_{charge}$, during which time flow mass and noise previously accumulated at pressure in accumulator 210A continue to be transmitted from accumulator 210A through interrupter 220A into accumulator 210B, and the pressure in accumulator 210A continues to decrease.

Interruptor 220B remains in the closed state, whereby the transmittance path is effectively blocked, and flow mass and noise continue to accumulate in accumulator 210B. In this manner, it will be appreciated that the pressure in accumulator 210A will decrease, and the pressure in accumulator 210B will increase, so as to approach equilibrium with the pressure in accumulator 210A. Preferably, $T_{charge}$ is selected so as to permit the pressure in accumulator 210B to approach equilibrium with the pressure in accumulator 210A.

Step (7); $V_1$ Closing:

Exhaust flow mass and noise from the noise source 212 continue to flow from the noise source 212 through the inlet 214 into accumulator 210A and accumulate therein.

Interruptor 220A is closed so as to isolate accumulator 210B from accumulator 210A and confine a charge of compressed flow mass and noise in accumulator 210B. As noted above, since interrupter 220B is in the closed state and the transmittance path of fluid borne noise to the external environment 218 is interrupted, whereby no significant fluid borne noise is transmitted to the external environment 218, interrupter 220A preferably is closed as quickly as possible, and most preferably is closed within a time $dt_3$~0.

The operation sequence now returns to Step 1, to attenuate exhaust noise confined in accumulator 210B by ringdown, and the phased exhaust operation is repeated.

This repeated sequence of seven steps thus provides a phased exhaust operation, contrasted with the "steady gross flow" operation of conventional silencers, where interrupters 220A, 220B (valves $V_1$, $V_2$), controlled by associated control elements (e.g., an electronic controller or computer as is well known in the art) provide means for selectively accumulating and confining compressible flow mass and noise in accumulator 210B so as to attenuate noise in accumulator 210B (phased transmittance means). The phased exhaust operation timing has a duration $T_{cycle}$ that may be represented as follows:

$$T_{cycle}=T_{ringdown}+T_{V2opening}+T_{vent}+dt_1+dt_2+T_{charge}+dt_3$$

It will be appreciated that the timing of four of the seven steps, namely the Ringdown, $V_2$ Opening, Venting, and Charging steps, is important to the acoustic performance, as well as the mechanical performance, of the noise attenuation system and method. The timing for each of these steps desirably is sufficiently long to permit adequate attenuation of fluid borne noise by ringdown, yet sufficiently short to avoid any appreciable impact on mechanical performance of the exhaust system or mechanical performance of the noise source (engine). The timing of the remaining three steps is of secondary consideration. Nevertheless, as discussed above, each of the corresponding times $dt_1$, $dt_2$, and $dt_3$ preferably is as short as possible, and most preferably is approximately zero (i.e., instantaneous).

A second embodiment of a noise attenuation system of the present invention will now be described in detail with reference to FIG. 3 and Example II. Specifically, in this embodiment the noise attenuation system also is a phased exhaust system for a noise source 312 such as a conventional engine. As noted above, FIG. 3 schematically illustrates a phased noise attenuation system including a plurality of accumulators and a plurality of interrupters arranged in a parallel configuration. As shown therein, in simplest form a parallel configuration noise attenuation system includes two accumulators 310A, 310B and four interrupters 320$A_1$, 320$A_2$, 320$B_1$, 320$B_2$ arranged in parallel and providing respective transmittance paths for exhaust flow between a noise source 312, such as a conventional engine, and an external environment 318. The first accumulator 310A is arranged for fluid communication with the noise source 312 through an inlet 314, and for fluid communication with the external environment 318 through an outlet 316A. Likewise, the second accumulator 310B is arranged for fluid communication with the noise source 312 through an inlet 314, and for fluid communication with the external environment 318 through an outlet 316B. The first interrupter 320$A_1$ is arranged in the transmittance path between first accumulator 310A and inlet 314, and the second interrupter 320$A_2$ is arranged in the transmittance path between the first accumulator 310A and outlet 316A. The third interrupter 320$B_1$ is arranged in the transmittance path between second accumulator 310B and inlet 314, and the fourth interruptor 320$B_2$ is arrange in the transmittance path between second accumulator 310B and outlet 316B. In the present embodiment, each interrupter 320$A_1$, 320$A_2$, 320$B_1$, 320$B_2$ includes a conventional valve, such as a pipe valve, and conventional control elements for selectively operating each valve at respective timings, as discussed below. That is, the control elements provide means for controlling operation of the interrupters 320$A_1$, 320$A_2$, 320$B_1$, 320$B_2$.

Figure 5:
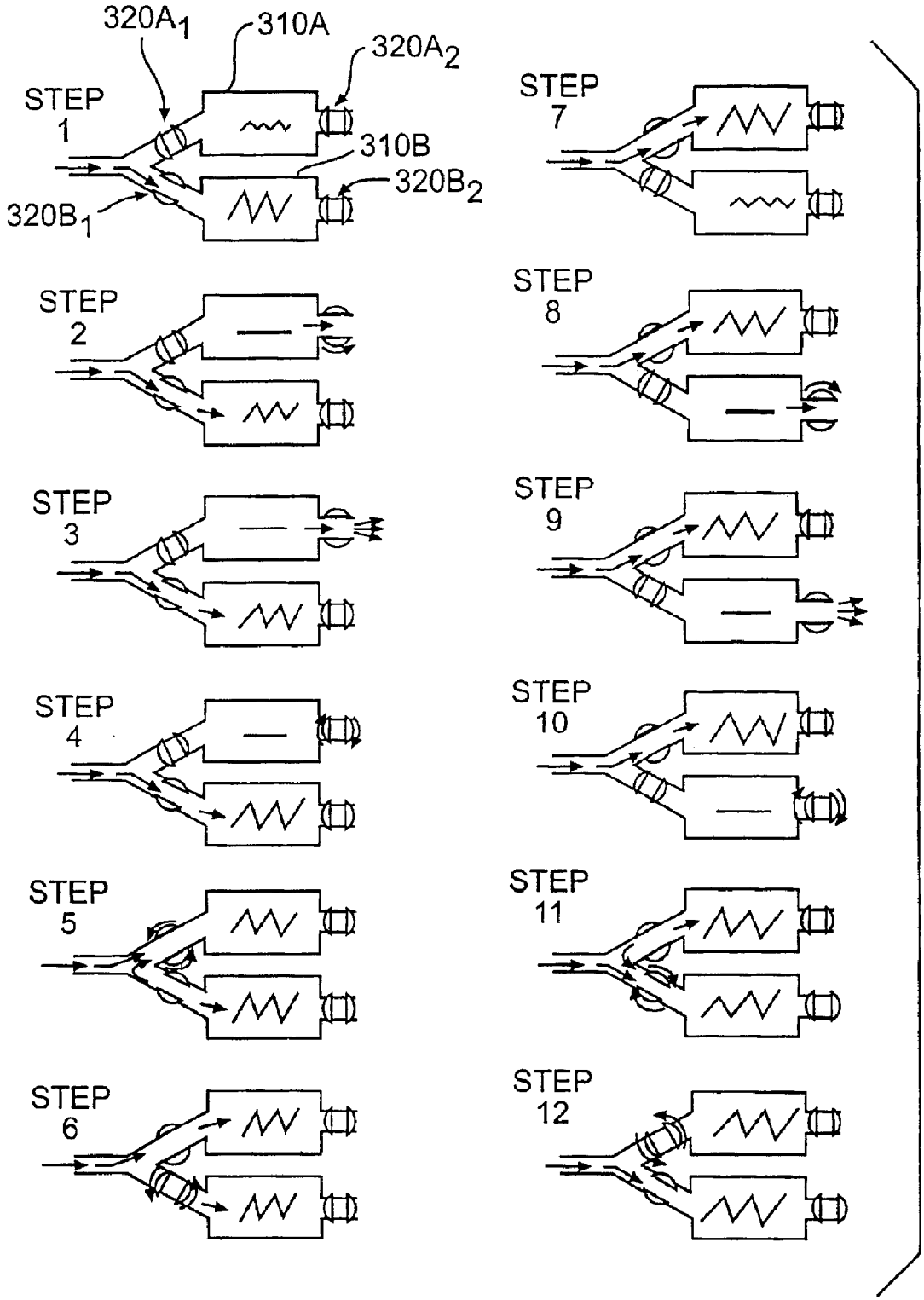
FIG. 5 is a pictorial flow chart illustrating operation of a parallel configuration phased noise attenuation system of FIG. 3.

Operation of a parallel configuration phased exhaust/noise attenuation system of FIG. 3, including two accumulators and four interrupters (valves), will now be described with reference to the flow chart illustrated in FIG. 5. As shown therein, operation of the parallel configuration phased exhaust/noise attenuation system generally comprises twelve steps, as follows:

Step (1); Ringdown A, Charge B

Interruptors 320$A_1$ and 320$A_2$ each are in the closed state, whereby flow mass and noise previously accumulated in accumulator 310A are confined therein for a period $T_{Aringdown}$, and noise confined in accumulator 310A is attenuated by ringdown. Interruptor 320$B_1$ is in the open state and interrupter 320$B_2$ is in the closed state, whereby exhaust flow mass (gases) and noise from the noise source 312 flow from the noise source 312 into accumulator 310B, and are accumulated therein. It will be appreciated that as exhaust flow mass and noise accumulate in accumulator 310B, the pressure in accumulator 310B (and the inlet 314 upstream of accumulator 310B) gradually will increase.

Step (2); Release A, Charge B

Interruptor 320$A_1$ remains in the closed state and interrupter 320$A_2$ is opened. In this manner, exhaust flow mass confined at elevated pressure in accumulator 310A will begin to release through interrupter 320A2 and the outlet 316A to the external environment 318. Interruptor 320$A_2$ preferably is opened in accordance with a controlled, predetermined opening profile. Specifically, interrupter 320$A_2$ preferably is controlled to open over a predetermined period of time $T_{VA2opening}$ with an opening profile that minimizes any noise generated by expansion of compressed flow mass confined in accumulator 310A as it is transmitted through interrupter 320$A_2$ and outlet 316. As in opening step (3) of Embodiment 1 above, $T_{VA2opening}$ preferably is small relative to other time periods in this operation, and most preferably is substantially less than $T_{ringdown}$. Also, the opening profile preferably is selected to minimize noise generation, such as a quasi-parabolic opening profile (see discussion above). Those skilled in the art readily will be able to select a combination of $T_{VA2opening}$ and opening profile suitable for the desired application.

Interruptor 320$B_1$ remains in the open state and interrupter 320$B_2$ remains in the closed state. Accordingly, during Step (2), exhaust flow mass and noise from the noise source 312 continue to flow from the noise source 312 into accumulator 310B, and are accumulated therein, whereby the pressure in accumulator 310B (and in inlet 312 upstream of accumulator 310B) continues to increase.

Step (3); Vent A, Charge B

Interruptor 320$A_1$ remains in the closed state and interrupter 320$A_2$ is in the open state for a time $T_{AVent}$, so as to permit venting of accumulator 310A. Preferably, $T_{Avent}$ is selected so as to permit substantial venting of all exhaust flow mass confined at elevated pressure in accumulator 310A by transmittance through interrupter 320$A_2$ and outlet 316A to the external environment 318, whereby the pressure within accumulator 310A will approach that of the external environment 318. Since noise (acoustic energy) in accumulator 310A was effectively attenuated by ringdown in Step (1) above, it will be appreciated that no significant engine noise will be transmitted to the external environment 318 during the venting of step (3).

Interruptor 320$B_1$ remains in the open state and interrupter 320$B_2$ remains in the closed state. Accordingly, during Step (3), exhaust flow mass and noise from the noise source 312 continue to flow from the noise source 312 into accumulator 310B and are accumulated therein, whereby the pressure in accumulator 310B (and in inlet 312 upstream of accumulator 310B) continues to increase.

Steps (4), (5), (6); Rapid Switching 1:

Step (4)

Interruptor 320$A_2$ is closed to seal off accumulator 310A from the external environment 318. Preferably, interrupter 320$A_2$ is closed as quickly as possible, and most preferably interrupter 320$A_2$ is closed within a time $T_{VA2close}$~0.

Step 5

Interruptor 320$A_1$ is opened to begin charging accumulator 310A. Preferably, interruptor 320$A_1$ is opened as quickly as possible, and most preferably interrupter 320$A_1$ is opened within a time $T_{VA1open}$~0.

Interruptor 320$B_1$ remains in the open state and interrupter 320$B_2$ remains in the closed state. Accordingly, it will be appreciated that in Step (5) some flow mass and noise previously accumulated at elevated pressure in accumulator 310B and in inlet 312 upstream of accumulator 310B may regurgitate through inlet 312 to accumulator 310A.

Step 6

Interruptor 320$B_1$ is closed to isolate accumulator 310B. Preferably, interrupter 320$B_1$ is closed as quickly as possible, and most preferably interrupter 320$B_1$ is closed within a time a $T_{VB1close}$~0.

In accordance with one goal of the present invention, the rapid switching of interrupters (valves) 320$A_2$, 320$A_1$, 320$B_1$ is sequenced so that each of the respective transmittance paths through accumulator 310A and accumulator 310B is selectively interrupted at at least one point along the transmittance path at all times, whereby each respective transmittance path between the noise source 312 and the external environment 318 is non-continuous. As noted above, each of $T_{VA2close}$, $T_{VA1open}$, $T_{VB1close}$ preferably approaches zero, such that the collective duration of the rapid switching $T_{switching1}$ also approaches zero, or instantaneous switching. It will be appreciated that this minimizes regurgitation in Step (5), and any associated additional noise generated thereby. It also will be appreciated that this rapid switching (approaching zero/instantaneous) increases the efficiency of the noise attenuation system.

Steps (7) to (12) mirror Steps (1) to (6), where the operations and functions of accumulator 310A and accumulator 310B, and their respective interrupters (valves) 320$A_1$, 320$A_2$, 320$B_1$, 320$B_2$ are reversed. Namely, in Step (7), accumulator 310A is charged and noise in accumulator 310B is attenuated by ringdown; in Step (8), interrupter 320$B_2$ is opened to release noise attenuated flow mass confined at pressure in accumulator 310B, while accumulator 310A is charged; in Step (9), accumulator 310B is vented, while accumulator 310A is charged; and in Steps (10), (11) and (12) rapid switching of interrupters 320$B_2$, 320$B_1$, and 320$A_1$ is sequenced at corresponding timings to return operation of the attenuation system to Step (1), where the overall operation is repeated. In this manner, transmission of exhaust flow mass and noise from the noise source 312 to the external environment 318 is phased.

This repeated sequence of 12 steps thus also provides a phased exhaust operation, contrasted with the steady gross flow operation of conventional silencers, where interrupters 320$A_1$, 320$A_2$, 320$B_1$, 320$B_2$, controlled by associated control elements (e.g., an electronic controller or computer as is well known in the art) provide means for selectively accumulating and confining compressible flow mass and noise in accumulators 310A, 310B (the phased transmittance means). The phased exhaust operation timing has a duration $T_{cycle}$ that may be represented as follows:

$$T_{cycle}=T_{Aringdown}+T_{VAopen}+T_{VAvent}+T_{switching1}+T_{Bringdown}+T_{VBopen}+T_{VBvent}+T_{switching2}$$

It will be appreciated that the timing of six of the twelve steps, namely steps (1), (2), (3), (7), (8) and (9) is important to the acoustic performance, as well as the mechanical performance of the noise attenuation system and method. The timing of each of these steps desirably is sufficiently long to permit adequate noise attenuation by ringdown, yet sufficiently short to avoid any appreciable negative impact on the mechanical performance of the noise attenuation system. The timing of the remaining steps, the rapid switching steps, is of secondary consideration. Nevertheless, as discussed above, the rapid switching timing preferably is as short as possible, and most preferably is approximately zero (instantaneous).

Although each of the above discussed preferred embodiments of the phased noise attenuation system uses only two accumulators, as schematically illustrated in FIGS. 2 and 3, those skilled in the art readily will appreciate that the design and operation principles described above in detail may be applied to phased noise attenuation systems having more than two accumulators arranged either in series configuration or in parallel configuration. Moreover, those skilled in the art readily will appreciate that each "accumulator" in each of these embodiments (series and parallel configurations), schematically illustrated in block diagram form, may include plural elements, including conventional accumulation chambers, silencers or other elements (see definitions provided above), provided that each "accumulator" operates as a unit in accordance with the above-described operation principles.

It will be appreciated that each of the preferred embodiments provides a novel phased noise attenuating system and method that achieves the above discussed objects of the present invention.

It also will be appreciated that the phased exhaust method of each of these examples and embodiments of the present invention has an additional benefit of lowering the dominant frequencies of the exhaust noise, which may be advantageous in certain applications.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. For example, the novel noise attenuation method of the present invention also may be applied to inlet silencers. The scope of the following claims is to be accorded the broadest interpretation so as to encompass all modifications and equivalent structures and functions.

What is claimed:

1. A method for attenuating noise comprising:

arranging a plurality of accumulators in series to form a transmittance path between a noise source and an external environment and selectively accumulating and confining compressible flow mass and noise from a noise source within at least one of the plurality of accumulators disposed downstream of a first accumulator disposed proximate the noise source, at respective timings, thereby attenuating noise within the at least one accumulator by ringdown.

2. A method according to claim 1, wherein the flow mass is exhaust of the noise source.

3. A noise attenuator comprising:

a first accumulator and a second accumulator arranged in a series configuration and providing a transmittance path for compressible flow mass and noise between a noise source and an external environment;

a first interruptor provided in fluid communication with the first accumulator and selectively operable to effectively block the transmittance path through the first accumulator at a first timing; and a second interruptor provided in fluid communication with the second accumulator and selectively operable to effectively block the transmittance path through the second accumulator at a second timing, different than the first timing, whereby the transmittance path from the noise source to the external environment is non-continuous.

4. A noise attenuator according to claim 3, wherein the first interruptor is provided in the transmittance path between the first accumulator and the second accumulator, and the second interruptor is provided in the transmittance path between the second accumulator and the external environment.

5. A noise attenuator according to claim 4, wherein at least one of the first interruptor and the second interruptor comprises a valve.

6. A noise attenuator according to claim 4, wherein each of the first interruptor and the second interruptor comprises a valve.

7. A noise attenuator according to claim 3, wherein the first interruptor and the second interruptor provide a transmittance path for exhaust flow and notice from the noise source.

8. A noise attenuator according to claim 7, wherein the noise source is an engine.

9. A noise attenuator according to claim 8, wherein the second accumulator has a maximum operable exhaust pressure, and the first accumulator is operable at an exhaust pressure greater than or equal to the maximum operable exhaust pressure of the second accumulator.

10. A noise attenuator according to claim 3, wherein a construction of the first accumulator is different than a construction of the second accumulator.

11. A noise attenuator according to claim 3, wherein the first accumulator and the second accumulator are identical.

12. A noise attenuator, comprising:

a plurality of accumulators arranged in series and collectively providing a transmittance path for compressible flow mass and noise between a noise source and an external environment, the plurality of accumulators including a first accumulator disposed immediately adjacent the noise source; and phase transmittance means for selectively accumulating and confining compressible flow mass and noise from the noise source within at least one of the plurality of accumulators disposed downstream of the first accumulator, at respective timings, thereby attenuating exhaust noise within the at least one accumulator by ringdown.

13. A noise attenuator according to claim 12, wherein the plurality of accumulators collectively provide a transmittance path for exhaust flow and noise from the noise source.

14. A noise attenuator according to claim 13, wherein the phased transmittance means selectively, effectively interrupts the flow of exhaust and noise through the transmittance path of each of at least two adjacent accumulators, downstream of the first accumulator, at respective timings.

* * * * *